US010179998B1

(12) United States Patent
Ramp et al.

(10) Patent No.: US 10,179,998 B1
(45) Date of Patent: Jan. 15, 2019

(54) AIR-BEAM AIRCELL COMMUNICATING AIRFLOW PORT ASSEMBLY AND COOPERATING STRUCTURAL COVER PORT APERTURE

(71) Applicant: ARGONAUT INFLATABLE RESEARCH AND ENGINEERING, INC., Meridian, ID (US)

(72) Inventors: Gregory D Ramp, Boise, ID (US); Michael O McCrosky, Meridian, ID (US)

(73) Assignee: ARGONAUT INFLATABLE RESEARCH AND ENGINEERING, INC., Meridian, ID (US)

( * ) Notice: Subject to any disclaimer, the term of this patent is extended or adjusted under 35 U.S.C. 154(b) by 0 days.

(21) Appl. No.: 15/885,707

(22) Filed: Jan. 31, 2018

Related U.S. Application Data

(60) Provisional application No. 62/452,939, filed on Jan. 31, 2017.

(51) Int. Cl.
*E04C 3/00* (2006.01)
*E04H 15/20* (2006.01)

(52) U.S. Cl.
CPC ..... *E04C 3/005* (2013.01); *E04H 15/20* (2013.01); *E04H 2015/201* (2013.01)

(58) Field of Classification Search
CPC ... E04C 3/005; E04H 15/20; E04H 2015/201; B63B 35/74; B63B 7/08; Y10T 403/7001; Y10T 403/7003
USPC ..... 52/2.18; 441/40, 41, 42, 66, 129; 114/345, 348–350; 403/346, 347
See application file for complete search history.

(56) References Cited

U.S. PATENT DOCUMENTS 3,034,154 A * 5/1962 Silverstone ..... B63C 9/02 244/905
3,092,854 A * 6/1963 Manhart ..... B63C 9/02 441/38
3,685,066 A * 8/1972 Edwards ..... B63C 9/04 441/41
4,083,070 A * 4/1978 Martin ..... B63B 7/08 441/40
4,197,681 A * 4/1980 Holcombe ..... E04C 3/005 135/119
4,312,484 A * 1/1982 Meisner ..... B64C 25/56 137/852
4,362,517 A * 12/1982 Martin ..... B63B 7/08 441/41
4,790,784 A * 12/1988 Givens ..... B63B 13/00 114/345
5,005,322 A * 4/1991 Mattick ..... E04H 15/20 52/25

(Continued)

*Primary Examiner* — Brian E Glessner
*Assistant Examiner* — Adam G Barlow
(74) *Attorney, Agent, or Firm* — Charles R. Clark

(57) ABSTRACT

An internal aircell inside a first flexible structural cover of a structural air-beam used in air supported supports such as tents is connected to the internal aircell of an adjacent air-beam by means of an air-beam aircell communicating airflow port assembly attached between said aircells through a cooperating structural cover port aperture in the structural cover. The airflow port assembly allows communicating airflow between the connected aircells forming an integral air volume for inflation and deflation through a single inflation point.

3 Claims, 10 Drawing Sheets

(56) References Cited

U.S. PATENT DOCUMENTS

| | | | | | |
|---|---|---|---|---|---|
| 5,419,726 | A * | 5/1995 | Switlik | B63B 35/58 | 114/345 |
| 5,604,945 | A * | 2/1997 | Fisher | A47C 27/081 | 441/129 |
| 6,260,306 | B1 * | 7/2001 | Swetish | E04H 15/20 | 135/124 |
| 6,293,840 | B1 * | 9/2001 | Garofalo | B63C 11/08 | 114/345 |
| 6,463,699 | B1 * | 10/2002 | Bailey | E04C 3/005 | 138/115 |
| 8,752,336 | B1 * | 6/2014 | Ozsuer | F41H 5/24 | 52/2.15 |
| 8,943,754 | B2 * | 2/2015 | Brensinger | E04C 3/005 | 52/2.11 |
| 9,404,256 | B2 * | 8/2016 | Adams | B64G 1/10 | |
| 2003/0181107 | A1 * | 9/2003 | Kuan | B63B 7/08 | 441/40 |
| 2006/0033335 | A1 * | 2/2006 | Pedretti | E04H 15/20 | 285/412 |
| 2007/0251185 | A1 * | 11/2007 | Haggard | E04C 3/005 | 52/843 |
| 2009/0300993 | A1 * | 12/2009 | Lamke | E04H 15/20 | 52/2.18 |
| 2012/0131857 | A1 * | 5/2012 | Ross-da Silva | E04H 15/20 | 52/2.18 |
| 2012/0291362 | A1 * | 11/2012 | Milo | E04B 1/165 | 52/2.18 |
| 2014/0130264 | A1 * | 5/2014 | Misaki | A47C 27/10 | 5/713 |
| 2015/0101258 | A1 * | 4/2015 | Milo | E04H 15/20 | 52/2.18 |

* cited by examiner

AIR-BEAM AIRCELL COMMUNICATING AIRFLOW PORT ASSEMBLY AND COOPERATING STRUCTURAL COVER PORT APERTURE

CROSS-REFERENCE TO RELATED APPLICATIONS

This application claims the benefit of U.S. Provisional Application No. 62/452,939, filed Jan. 31, 2017.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Field of the Invention

The present invention relates to joining an internal aircell inside a first air-beam structural cover of one air-beam to an adjacent internal aircell of another air-beam by means of an air-beam aircell communicating airflow port assembly 10 attached between said aircells preferably through a cooperating structural cover port aperture 42 in said structural cover. The invention is useful in durably and effectively joining one air-beam to an aircell in an adjacent air-beam such as in fabricating an improved air supported tent structure 4 (see FIGS. 13 and 30) having a plurality of air-beam support legs 6, 7, 9 joined one to another at their upper ends with each said support leg having an internal aircell enclosed by a flexible structural cover 14, 20 that becomes rigid when said internal aircell is inflated and each said aircell connected through at least one structural cover to an aircell in an adjacent air-beam.

The present invention, the aircell airflow port assembly 10 provides a mechanism and means to connect a first aircell to a corresponding parallel, angled, or perpendicular second aircell preferably through a cover port aperture in the structural cover of the first aircell to allow communicating airflow between the connected aircells forming an integral air volume without the use of special fittings, hoses, air lines, or valves thus allowing for complete inflation and deflation of a multi-aircell system through a single inflation point. The present invention is an improvement over other less capable multi-aircell systems that use special fittings, hoses, air lines, or valves to connect two or more air-beams and their internal aircells into a single integral air volume. The present invention provides a clean and attractive profile with the connection between said aircells generally occurring inside a protective structural cover.

BRIEF SUMMARY OF THE INVENTION

The aircell communicating airflow port assembly 10 comprises two coaxial circular airflow port disks 22, 24 that are preferably congruent (preferably the disks are made from a flexible 40 to 60 mil polyurethane sheet material), each said disk is hermetically joined by joining means (RF welding, hot air welding, gluing, solvent welding, or other suitable welding method) to a respective outer surface of one of the two aircells 12, 18 that are to be joined with each said disk hermetically joined fully across one disk planar surface or along the disk perimeter of said disk planar surface to said outer surface, then said disks are hermetically, coaxially, and centrally joined one disk to the other facing disk by joining means (RF welding, hot air welding, gluing, solvent welding, or other suitable welding method) in a coaxial orientation at a contact position to and between said aircells 12, 18 forming a central disk seal 26 with said disk seal preferably coaxial to the facing disk perimeters. Preferably, the outside diameter (OD) dimension of said joined disks is roughly double in size compared to the outside diameter of the disk seal 26 (connecting weld) that connects said disks and said joined aircells.

Preferably, the outside diameter of the disk seal is sized to closely interface with the inner diameter of a communicating cover port aperture 42 of a first structural cover 14. The cover port aperture preferably is reinforced by a welded or otherwise adhered cover port aperture coaxial reinforcing ring 44 that encircles and provides a reinforced portion around said cover port aperture that helps to control circumferential stress loads A, axial stress loads B, and radial stress loads C associated with said aircells when inflated (see FIG. 9). Radial stress A is understood as a stress in a direction coplanar with, but perpendicular to the symmetry axis of the structural cover, axial stress B is understood as a normal stress in a direction parallel to the axis of cylindrical symmetry of the structural cover, and circumferential stress C (or hoop stress) is understood as a normal stress in a tangential direction.

Preferably, the diameter of the coaxial disk seal 26 formed between said disks can be selectively varied based on the properties of the specific aircells to be joined. Preferably, the outside diameter of the disks preferably will be selectively sized to provide two circular congruent coaxial disk flanges 28, 29 within a selected range radially outward from the outer perimeter of the disk seal to the perimeter of the disks of preferably two to four inches. In a best embodiment, the facing disk flanges 28, 29 receive and retain between said flanges the portion of the structural cover that immediately surrounds the communicating cover port aperture and the flanges provide a reinforced portion of the aircells outer surfaces that will fit through said communicating cover port aperture 42 in said first structural cover 14. After the aircells are joined together by the disk seal, a selected airflow port disk aperture 30 is punched or cut out at the center of the disk seal to allow airflow between said joined aircells.

A principal objective of the invention is to provide an air-beam structure manufacture such as a tent structure manufacturer, or other air-beam structure user with an improved airflow connection between connected aircells 12, 18 that uses a novel aircell communicating airflow port assembly 10 that is simple, low-maintenance, and reliable.

Additional and various other objects and advantages attained by the invention will become more apparent as the specification is read and the accompanying figures are reviewed.

DETAILED DESCRIPTION OF THE INVENTION

Referring to FIGS. 1 to 30, the present invention is a novel air-beam aircell communicating airflow port assembly 10 preferably used with a cooperating structural cover port 42 that joins and hermetically seals one aircell to another aircell to communicate the aircells one to the other and permit the inflation and deflation of the joined aircells by a single air inflation valve 8.

Figure 1:
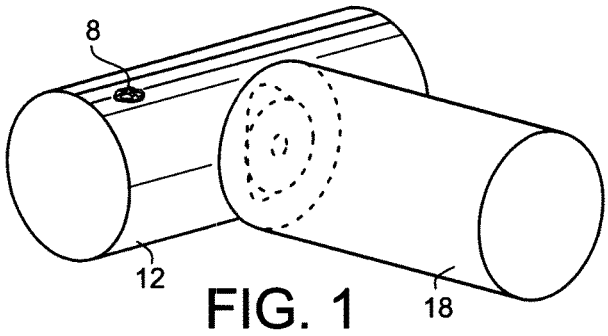
FIG. 1 is a simplified, perspective view of a first aircell 12 joined and hermetically sealed and connected to a second aircell 18 by a first embodiment of the airflow port assembly 10 and shows an air inflation valve 8.
Figure 2:
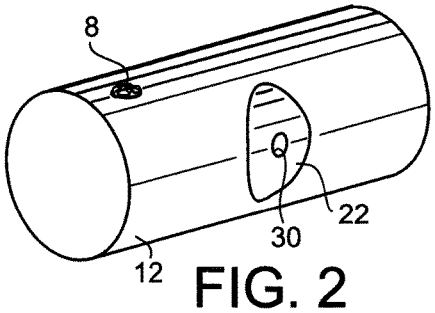
FIG. 2 is a simplified, perspective view of a first aircell 12 showing an airflow port disk 22 attached (joined) to the outer side of said first aircell with indicia on said disk indicating the location of an airflow port disk central communicating aperture 30 to be later formed.
Figure 3:
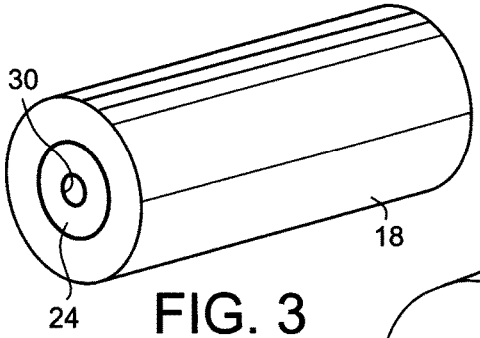
FIG. 3 is a simplified, perspective view of a second aircell 18 showing an airflow port disk 24 attached (joined) to the outer side of said second aircell with indicia on said disk indicating the location of an airflow port disk central communicating aperture 30 to be later formed.
Figure 4:
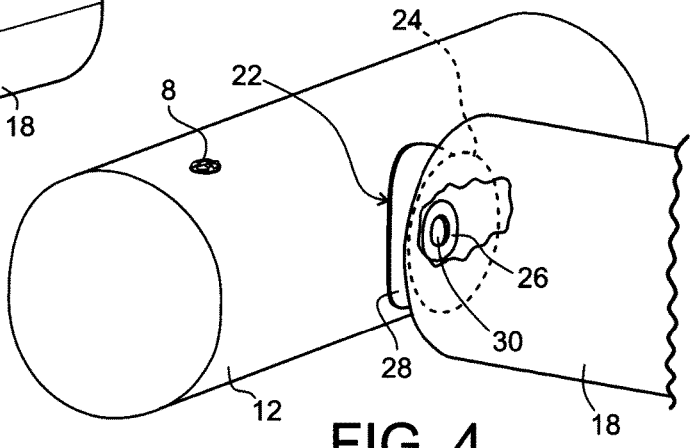
FIG. 4 is a partial, cutaway, perspective view of the airflow port assembly 10 shown in FIG. 1.
Figure 5:
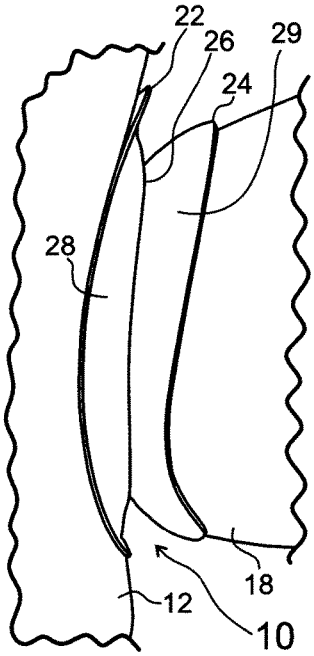
FIG. 5 is a simplified, partial side view of the aircell communicating airflow port assembly 10 shown in FIG. 1.
Figure 6:
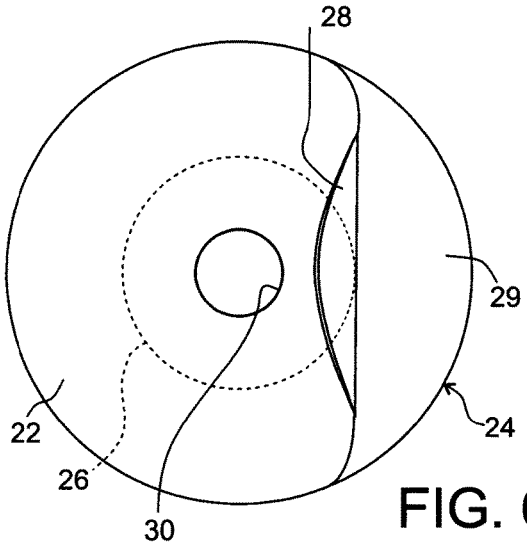
FIG. 6 is a top view of two facing coaxial circular airflow port disks 22, 24 showing a disk flange 28 of disk 22 folded upward to reveal the disk 24 and disk flange 29 below, and showing a central disk seal 26 that connects said disks.
Figure 7:
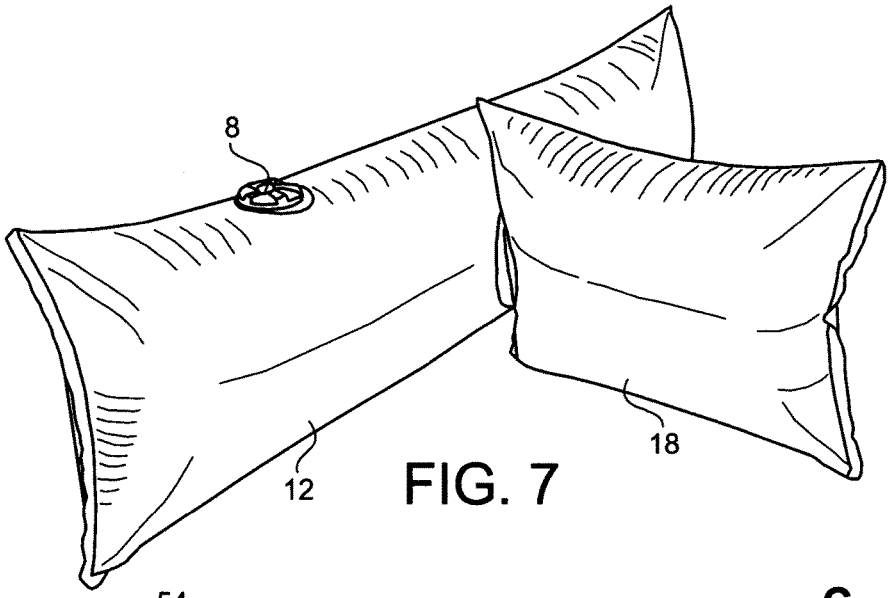
FIG. 7 is a perspective view of a first aircell 12 joined and hermetically sealed to a second aircell 18 by a first embodiment of the invention.
Figure 8:
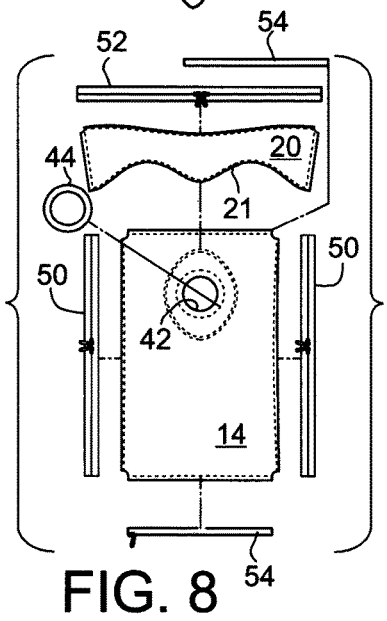
FIG. 8 is an exploded plan view of a first structural cover 14 to be assembled and connected (attached) to a second structural cover 20 to be assembled, said second structural cover having a coped end 21 as shown in FIG. 9.
Figure 9:
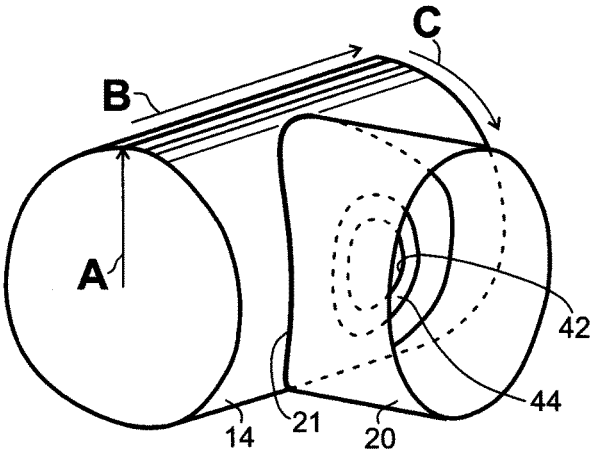
FIG. 9 is a perspective view of a first structural cover 14 connected (attached) to a second structural cover 20, said second structural cover having a coped end 21 and showing indicia A, B, and C.
Figure 10:
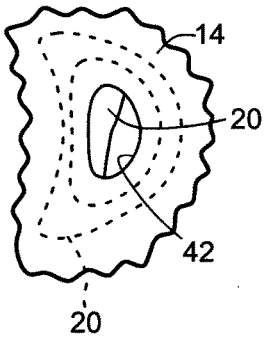
FIG. 10 is a partial, perspective view from within said first structural cover 14.
Figure 11:
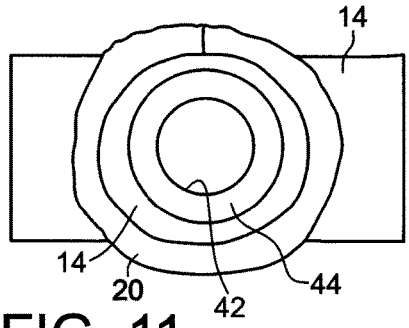
FIG. 11 is a side view of said first structural cover 14 and said second structural cover 20 shown in FIG. 9.
Figure 12:
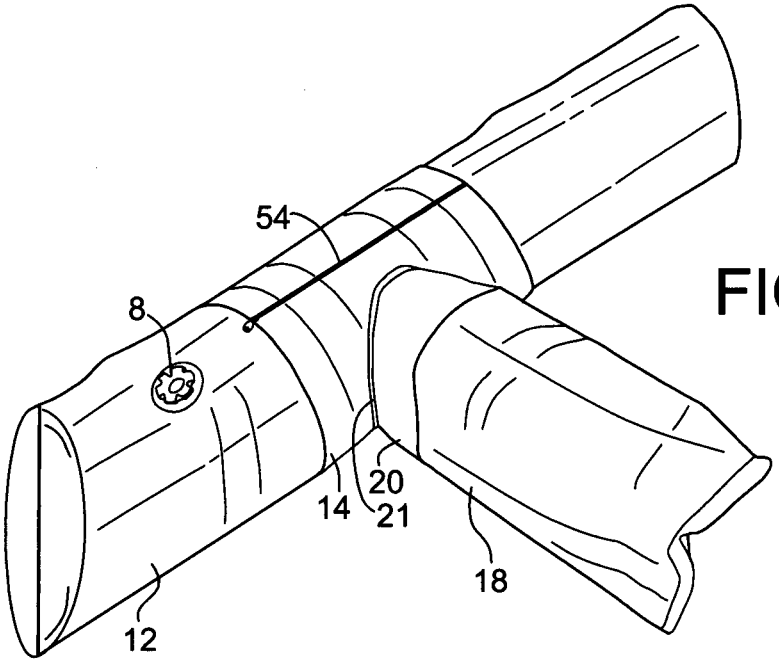
FIG. 12 is a perspective view of said first aircell 12 and said second aircell 18 shown in FIG. 7 inserted and retained within said first structural cover 14 connected (attached) to a second structural cover 20, said second structural cover having a coped end 21 and preferably further comprising a longitudinal spine zipper 54 joining two longitudinal edges of said first structural cover shown in FIG. 9 other cover zippers not shown.
Figure 13:
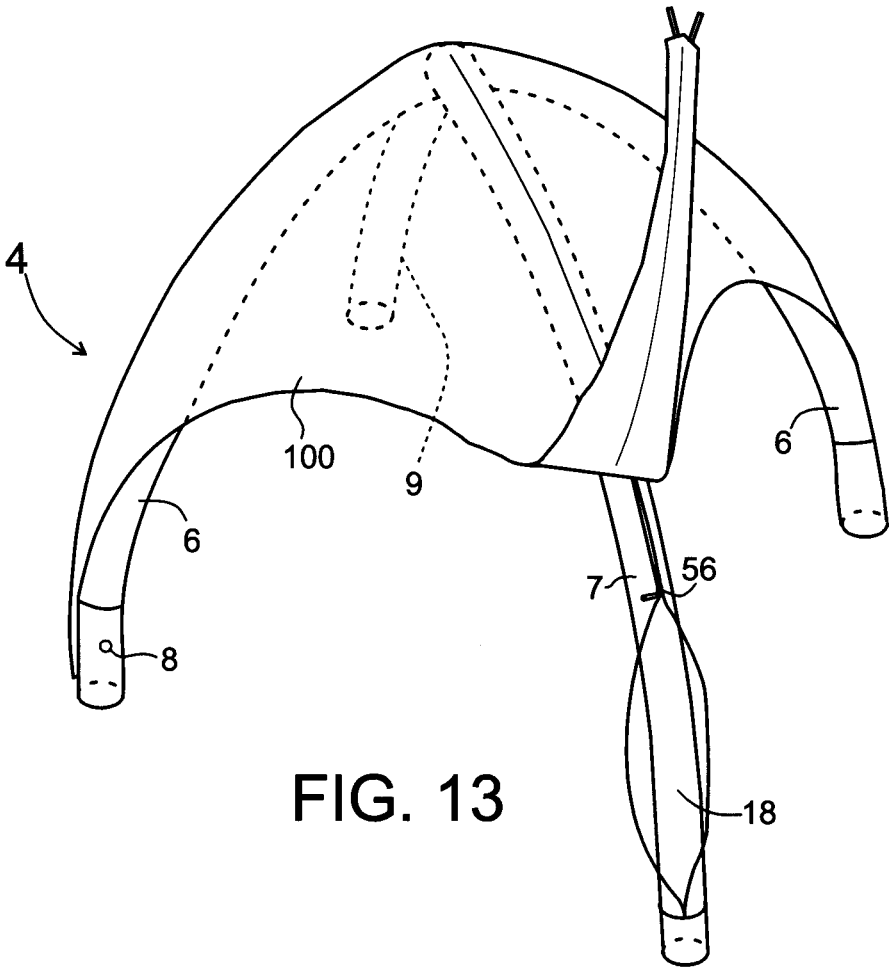
FIG. 13 is a perspective view of an air supported tent structure 4 showing a tent fly 100 partially uplifted and an air-beam support leg 7 having a partially opened spine zipper 56 allowing access to the interior of said leg and showing said internal aircell 18 within said support leg.
Figure 14:
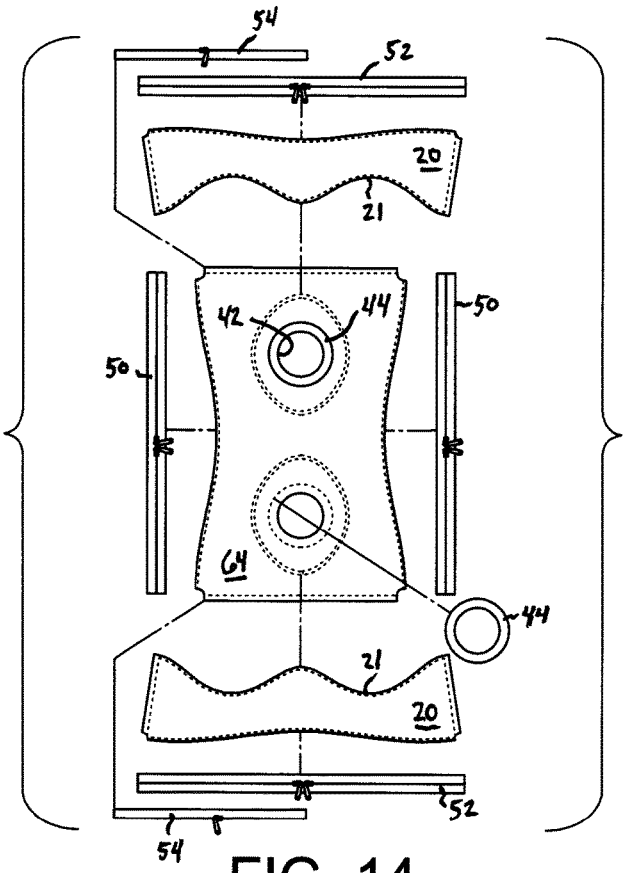
FIG. 14 is an exploded plan view of a best embodiment of a first structural cover 64 to be assembled and connected (attached) to a second structural cover 20 to be assembled, said second structural cover having a coped end 21 as shown in FIG. 15.
Figure 15:
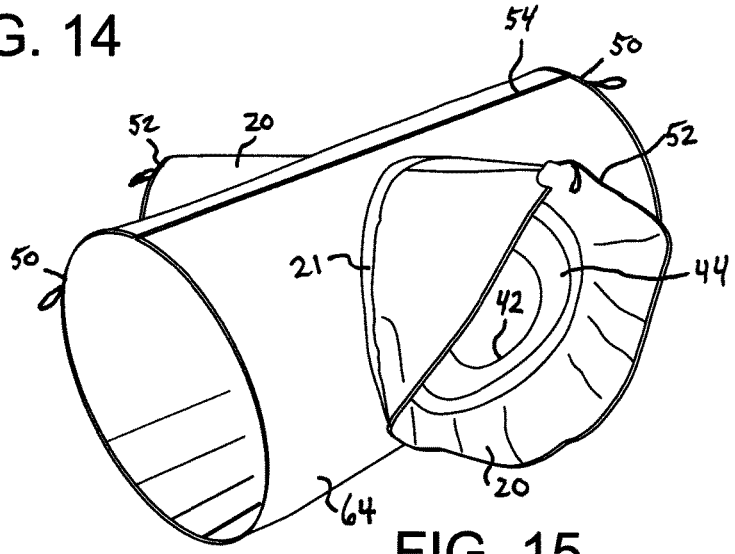
FIG. 15 is a perspective view of said first structural cover 64 connected (attached) to a second structural cover 20, said second structural cover having a coped end 21 and showing attachment zippers 50, 52 and spinal zipper 54.
Figure 16:
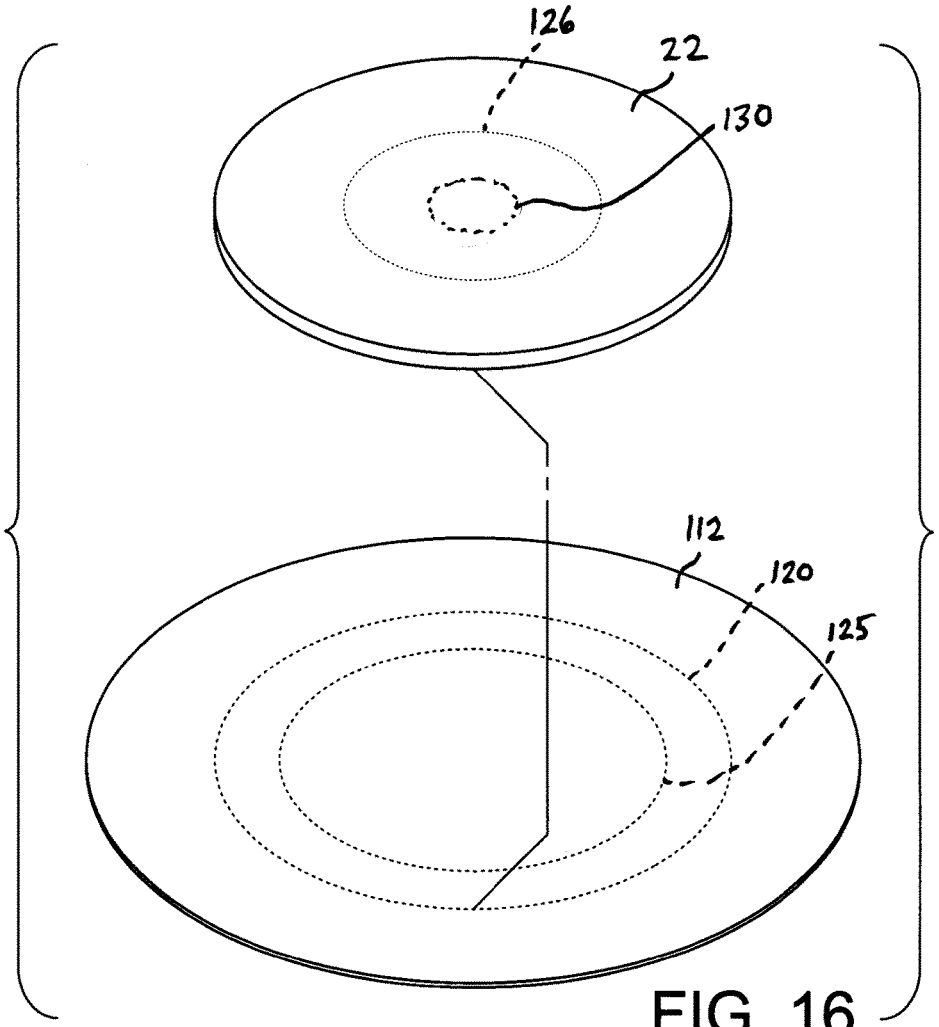
FIG. 16 is an exploded perspective view of an airflow port disk 22 spaced above a circular portion 112 of the outer surface of an aircell 12 and showing the following indicia: guideline to disk placement 120, guideline to inner perimeter 125 of perimeter weld of disk to outer surface of said aircell perimeter weld to be formed, guideline to disk seal outer perimeter 126 of seal to be formed, and guideline to airflow port disk central communicating aperture placement 130.
Figure 17:
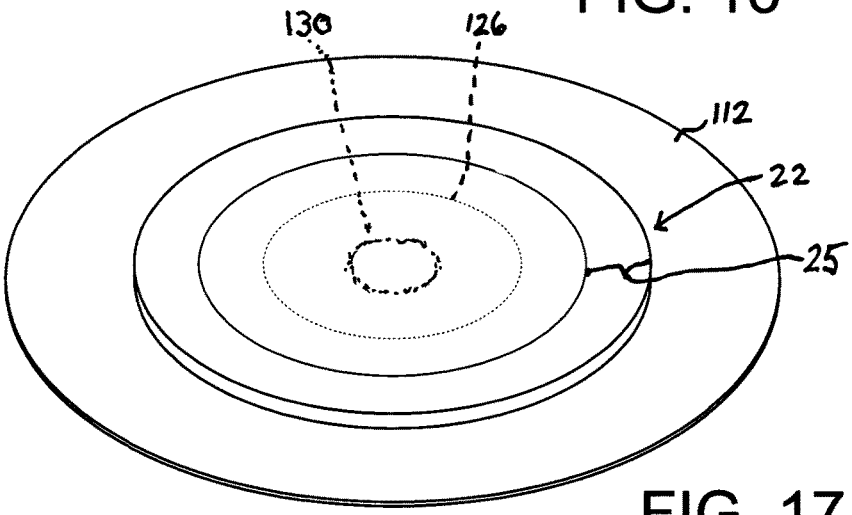
FIG. 17 is a perspective view of a airflow port disk 22 joined to said circular portion 112 of the outer surface of an aircell 12 and a perimeter weld 25 of disk to said outer surface, and showing the following indicia: guideline to disk seal outer perimeter 126 of seal to be formed, and guideline to airflow port disk central communicating aperture placement 130.
Figure 18:
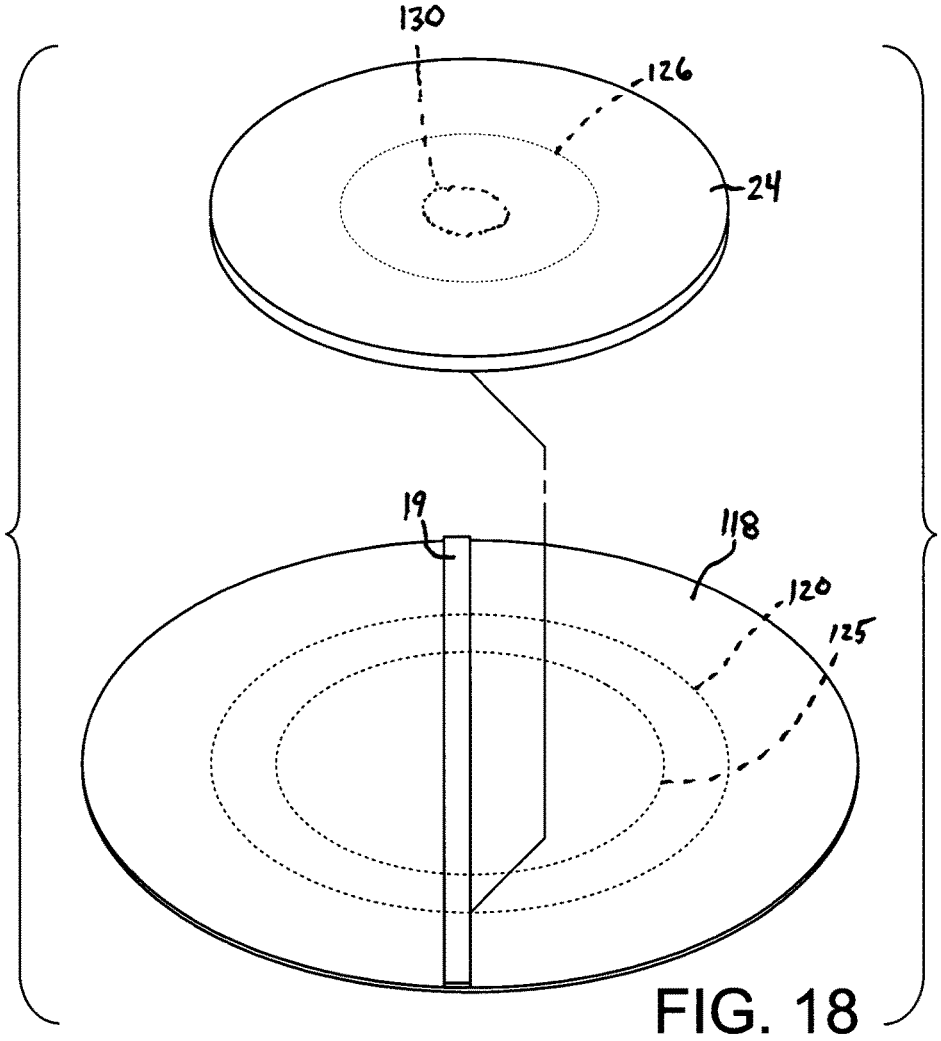
FIG. 18 is an exploded perspective view of a airflow port disk 24 spaced above a circular portion 118 of the outer surface of an aircell 18 and showing the following indicia: guideline to disk placement 120, guideline to inner perimeter 125 of perimeter weld of disk to outer surface of said aircell perimeter weld to be formed, guideline to disk seal outer perimeter 126 of seal to be formed, and guideline to airflow port disk central communicating aperture placement 130.
Figure 19:
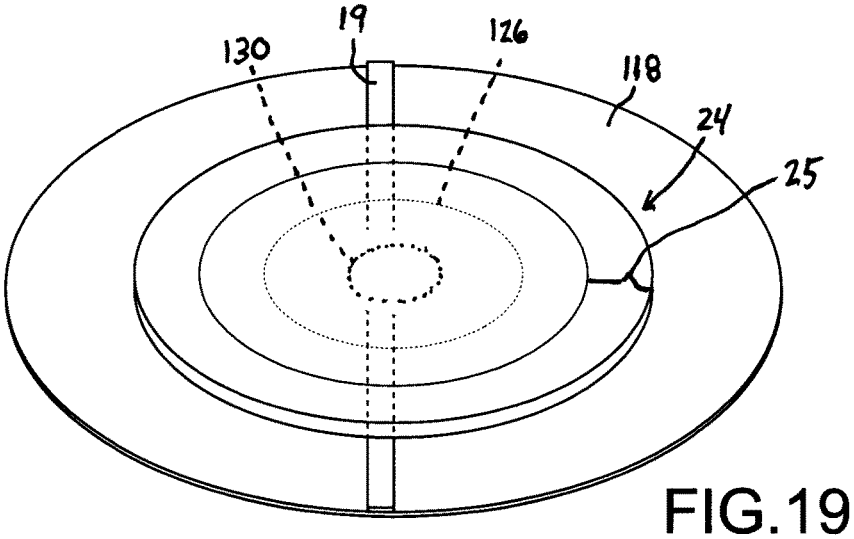
FIG. 19 is a perspective view of a airflow port disk 24 joined to said circular portion 118 of the outer surface of an aircell 18 and a perimeter weld 25 of disk to said outer surface, and showing the following indicia: guideline to disk seal outer perimeter 126 of seal to be formed, and guideline to airflow port disk central communicating aperture placement 130 (preferably after the perimeter weld is made, the portion of the outer surface 118 bounded by the inner perimeter of the perimeter weld is removed to lessen the impact of the flange 19 thickness on later forming of the disk seal.
Figure 20:
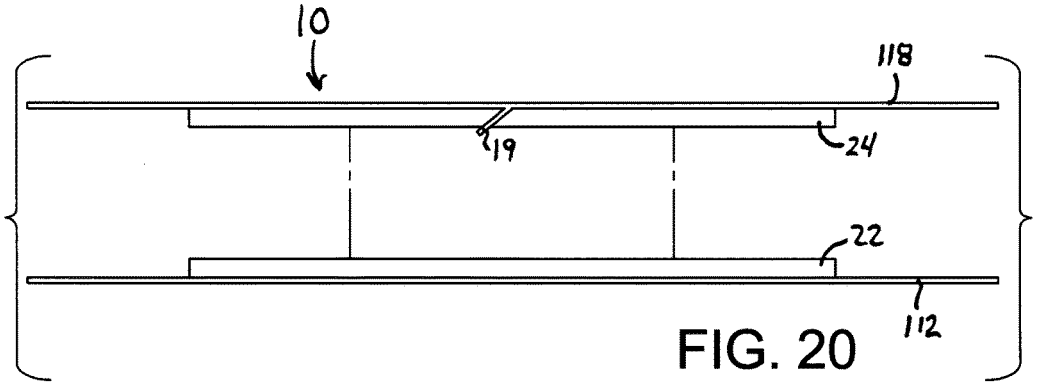
FIG. 20 is an exploded side view of an air-beam aircell communicating airflow port assembly 10 before a central disk seal 26 is formed between said disks 22, 24.
Figure 21:
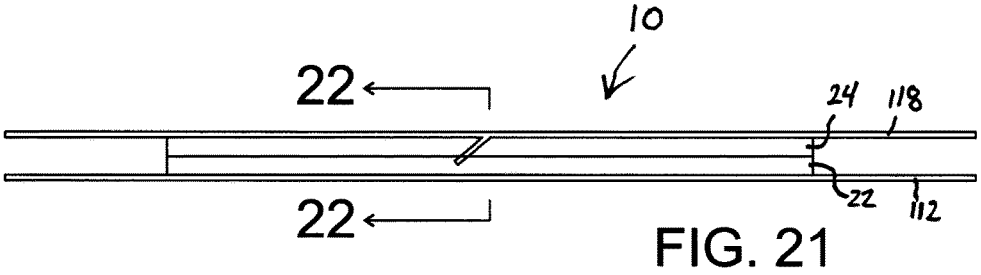
FIG. 21 is an side view of an air-beam aircell communicating airflow port assembly 10 after a central disk seal 26 is formed between said disks 22, 24 and indicating a cross-sectional view for FIG. 22.
Figure 22:
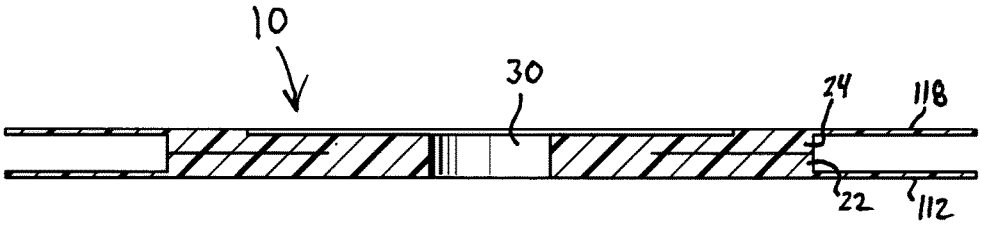
FIG. 22 is a cross-sectional view of said air-beam aircell communicating airflow port assembly 10 indicated in FIG. 21 and showing a coaxial airflow port disk central communicating aperture 30.
Figure 23:
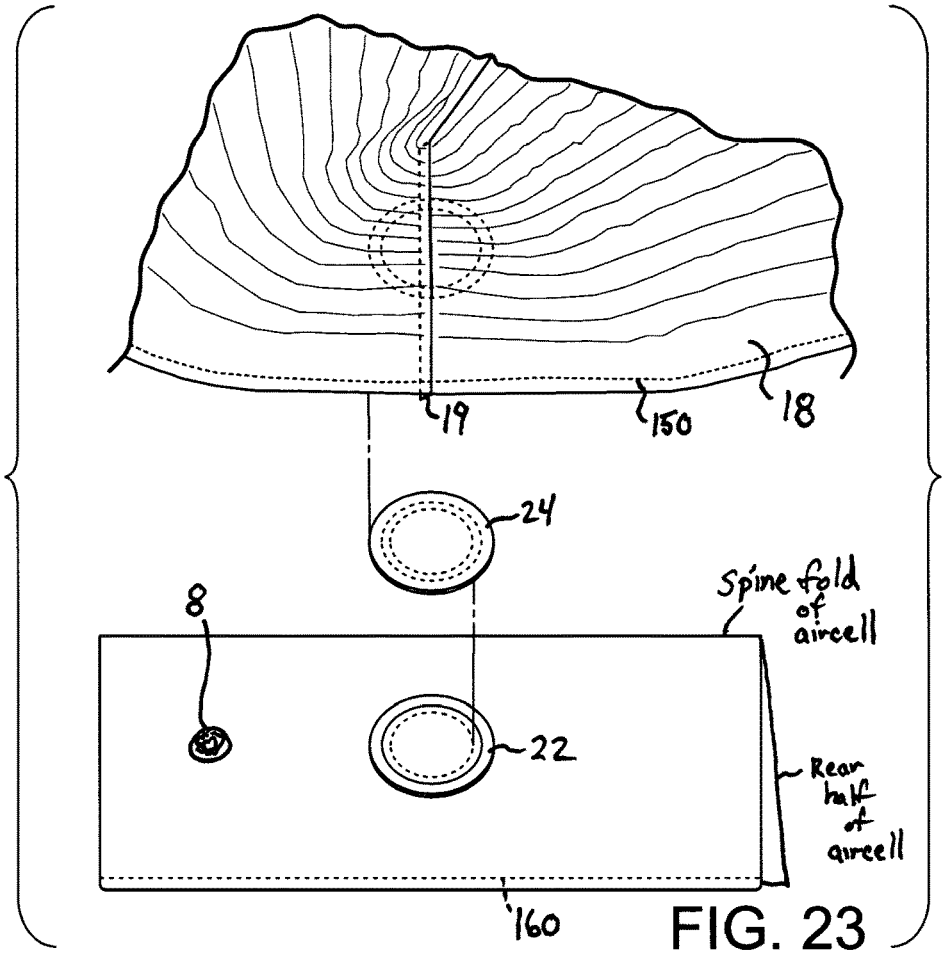
FIG. 23 is an exploded perspective view of an airflow port disk 24 spaced below a fin weld flange 19 and an opened end portion of the outer surface of said aircell 18 that is open along the belly weld line 150, and above an airflow port disk 22 that is joined to the outer surface of aircell 12 that is open along the belly weld line 160 to allow access during the fabrication process to the interior of said aircell 12.
Figure 24:
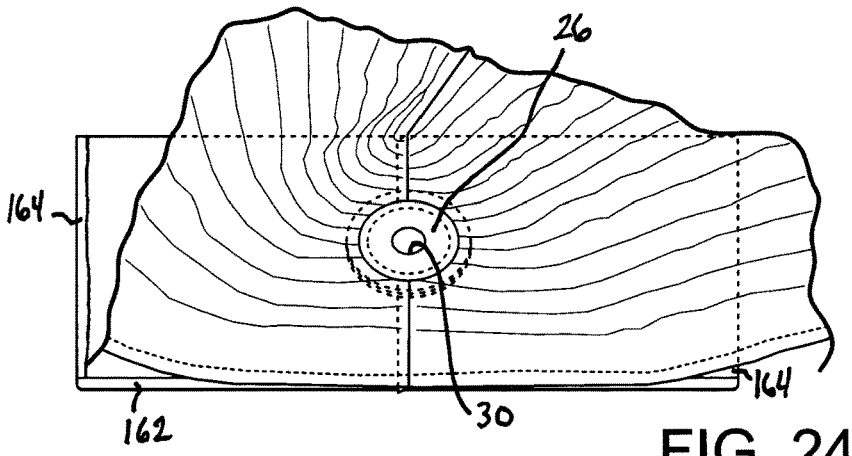
FIG. 24 is a perspective view of a airflow port disk 24 joined to said fin weld flange 19 and said opened end portion and joined by a central disk seal 26 to said airflow port disk 22 joined to the outer surface of aircell 12 and the belly weld 162 and two fin welds fully formed in aircell 12 and showing a airflow port disk central communicating aperture 30.
Figure 25:
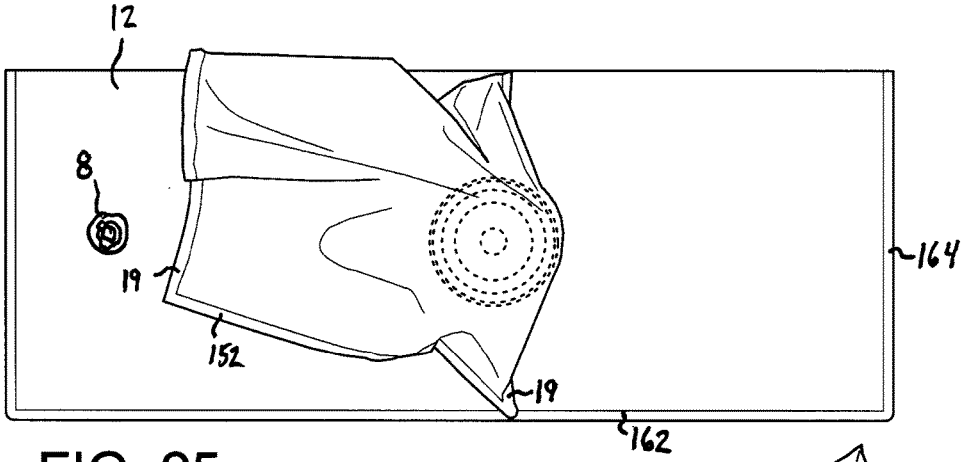
FIG. 25 is a top view of two aircells 12, 18 shown in FIG. 24 hermetically and fully joined one to the other with fin welds 19, 164 and belly welds 152, 162 welded and showing an attached air inflation valve 8.
Figure 26:
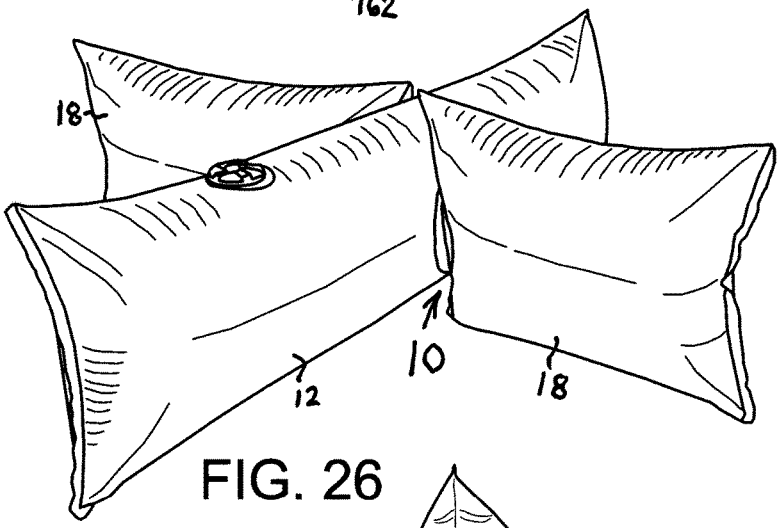
FIG. 26 is a perspective view of a first aircell 12 joined and hermetically sealed to a second aircell 18 and also to a third aircell 18.
Figure 27:
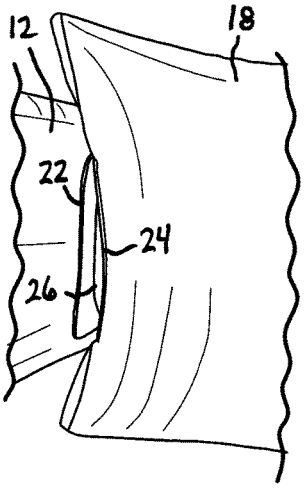
FIG. 27 is a partial perspective view of said aircell communicating airflow port assembly 10 shown in FIG. 26.
Figure 28:
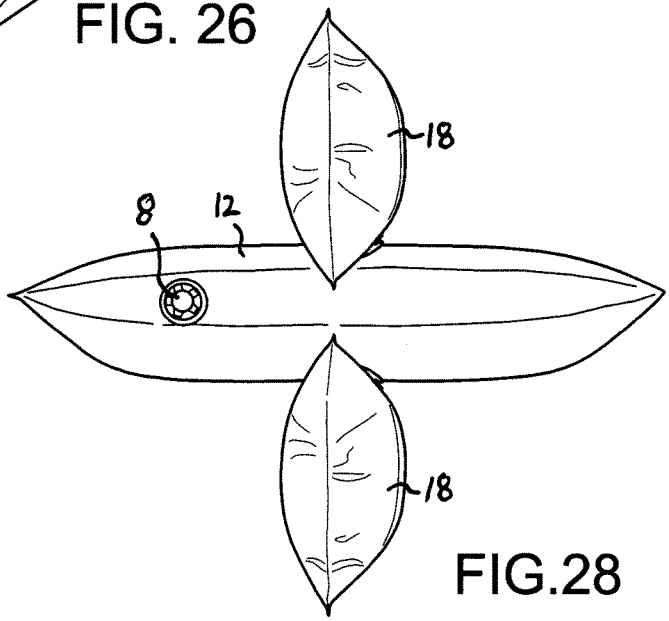
FIG. 28 is a top view of said first aircell 12 joined and hermetically sealed to said second aircell 18 and also to a third aircell 18 shown in FIG. 26.
Figure 29:
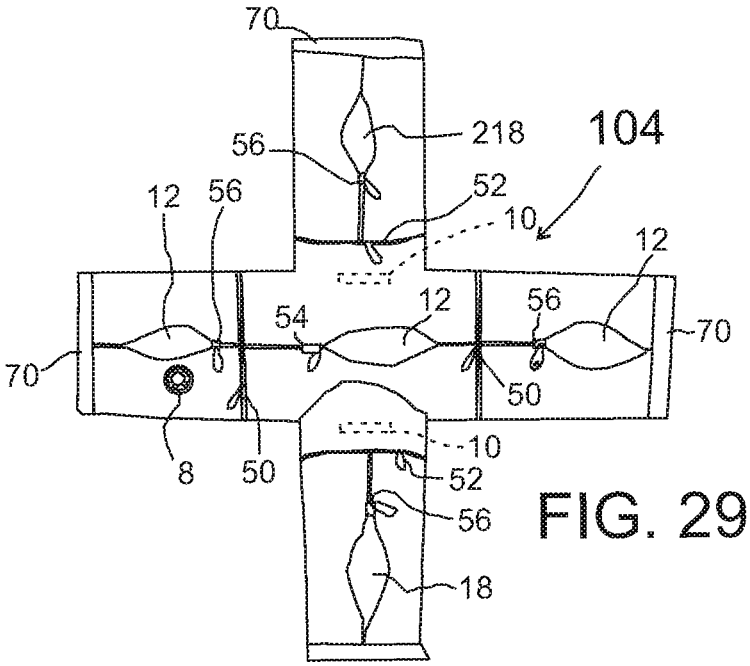
FIG. 29 is a top view of a second embodiment of an air-beam structure 104 having a first aircell 12 joined and hermetically sealed to a second aircell 18 and also to a third aircell 18 incorporating two port assemblies 10 and showing four cover end caps at four free ends of said air-beam structure.
Figure 30:
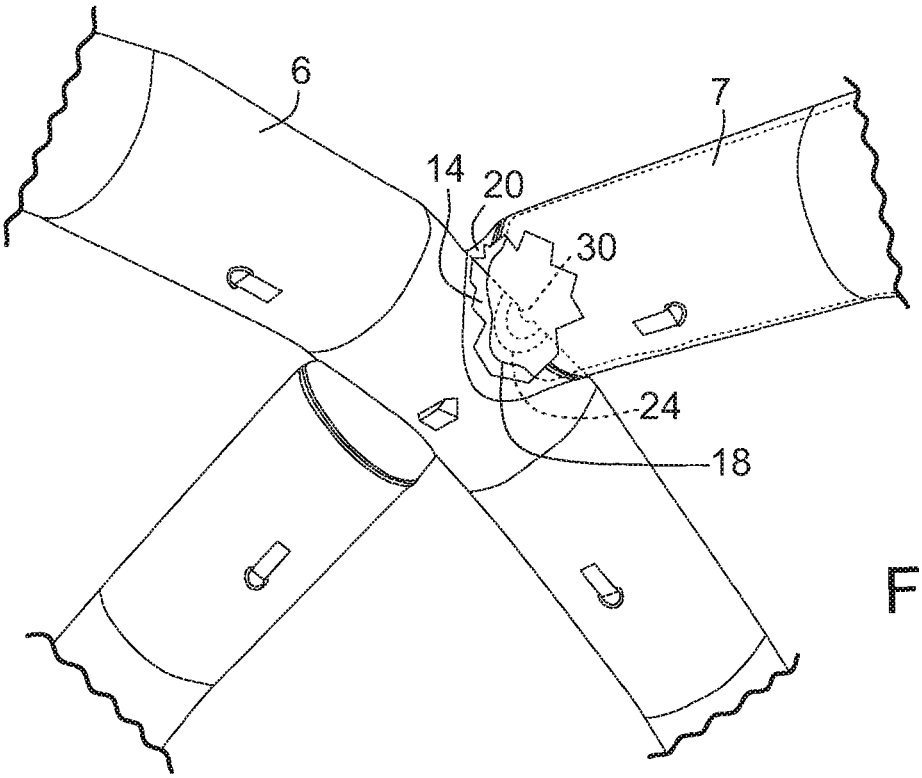
FIG. 30 is a partial, cutaway perspective view from below of the intersecting support legs 6, 7 of the air supported tent structure 4 shown in FIG. 13.

The invention is useful in the manufacture of air-beam structures as illustrated in FIG. 13 showing an air supported tent structure 4 having a plurality of air beam support legs 6, 7, 9 or in other instances where two or more aircells are to be joined and hermetically sealed to communicate one aircell to another aircell. The elements of the invention comprise

- a first aircell 12 having or connected to an aircell inflation valve 8 and said first aircell enclosed by a flexible non-elastic first structural cover 14;
- said first aircell joined and hermetically sealed by an air-beam aircell communicating airflow port assembly 10 to
- an adjacent second aircell 18 preferably enclosed by a flexible non-elastic second structural cover 20 having a coped end 21 joined to said first structural cover;
- said airflow port assembly comprising
- two coaxial circular airflow port disks 22, 24,
- said disks hermetically sealed preferably along their perimeters respectively to an outer surface of said first aircell and to an outer surface of said second aircell,
- said disks joined and hermetically sealed one disk to the other disk from their disk centers outwardly about halfway toward their outer disk perimeters forming an integral central disk seal 26 and forming
- two facing annular disk flanges 28, 29,
- an airflow port disk central communicating aperture 30 is punched or cut in and preferably perpendicularly through the central portion of said disk seal and through the outer surfaces of said aircells to allow flow of air or other inflating gas between said hermetically joined aircells;
- said first structural cover 14 having a communicating cover port aperture 42 into the interior volume of said second structural cover, said cover port aperture sized to closely receive there-through said second aircell and one of said disks that is sealed to said second aircell and said port aperture sized to closely interface said central disk seal along the outer diameter of said central disk seal and said cover port aperture and the immediately surrounding portion of the cover retained between said disk flanges of said airflow port assembly; and
- preferably a cover port aperture reinforcing ring 44 encircles said cover port aperture and is attached to said structural cover to reinforce said structural cover and maintain the integrity of said port aperture.

Preferably said aircells have a single inflation valve 8 for inflating and deflating the aircells 12, 18.

A majority of the fabric components of the invention (such as the structural covers 14, 20) are preferably made from a flexible non-elastic PVC coated flexible fabric material. The aircells preferably are made from flexible polyurethane film or sheet material or other suitable flexible inflating gas impervious material and preferably being about 12 to 14 mil in thickness. The airflow port disks preferably are made from flexible polyurethane sheet material or other suitable flexible inflating gas impervious material preferably about 40 to 60 mil in thickness and preferably when joining ten inch cross-sectional diameter aircells are six to eight inches in diameter and when joining other sized aircells up to 36 inch cross-sectional aircells are appropriately sized for such other sized aircells.

Means of joining or attaching of elements of the invention one element to another element preferably may include welding, hot air welding, RF welding, other suitable method of plastic welding, adhesive, or appropriate stitching.

The preceding description and exposition of a preferred embodiment of the invention is presented for purposes of illustration and enabling disclosure. It is neither intended to be exhaustive nor to limit the invention to the precise form disclosed. Modifications or variations in the invention in light of the above teachings that are obvious to one of ordinary skill in the art are considered within the scope of the invention as determined by the appended claims when interpreted to the breath to which they are fairly, legitimately and equitably entitled.

We claim:

1. An air-beam aircell communicating airflow port assembly for an air supported structure comprising a first aircell, two facing concentric circular airflow port disks, one of said disks joined and hermetically sealed to an outer surface of said first aircell, the other said port disk joined and hermetically sealed to an outer surface of a second aircell, said port disks hermetically joined together from their centers outwardly to about halfway to their outer perimeters forming an integral central disk seal and forming two facing annular disk flanges extending outwardly from said disk seal, and an airflow port disk central communicating aperture punched through the central portion of said disk seal and into said aircells to allow flow of inflating gas through said communicating aperture between said hermetically joined aircells.

2. An air-beam aircell communicating airflow port assembly in accordance with claim 1, wherein said first aircell enclosed by a flexible non-elastic structural cover, said first structural cover having a communicating cover port aperture through which said second aircell and one of said airflow port disks are inserted through and retained external to said first structural cover.

3. An air-beam aircell communicating airflow port assembly in accordance with claim 2, wherein said second aircell enclosed by a flexible non-elastic second structural cover.

* * * * *